US010160576B2

(12) United States Patent
Grunert et al.

(10) Patent No.: US 10,160,576 B2
(45) Date of Patent: Dec. 25, 2018

(54) CLOSURE WITH MEMBRANE AND ROTATABLE PROTECTIVE CAP

(75) Inventors: Lothar Grunert, Biblis (DE); Andreas Mrass, Darmstadt (DE); Peter Mueller, Griesheim (DE); Kemal Eray, Worms (DE); Thorsten Hassenzahl, Pfungstadt (DE); Klaus Oswald, Riedstadt (DE)

(73) Assignee: MERCK PATENT GMBH, Darmstadt (DE)

( * ) Notice: Subject to any disclaimer, the term of this patent is extended or adjusted under 35 U.S.C. 154(b) by 1554 days.

(21) Appl. No.: 12/666,967

(22) PCT Filed: Jun. 2, 2008

(86) PCT No.: PCT/EP2008/004363

§ 371 (c)(1),
(2), (4) Date: Dec. 28, 2009

(87) PCT Pub. No.: WO2009/003563

PCT Pub. Date: Jan. 8, 2009

(65) Prior Publication Data

US 2010/0176080 A1 Jul. 15, 2010

(30) Foreign Application Priority Data

Jun. 29, 2007 (DE) ..... 10 2007 030 352
Dec. 3, 2007 (DE) ..... 10 2007 058 349

(51) Int. Cl.
*B65D 47/26* (2006.01)
*B65D 41/34* (2006.01)
*B65D 51/00* (2006.01)

(52) U.S. Cl.
CPC ..... *B65D 47/265* (2013.01); *B65D 41/3404* (2013.01); *B65D 51/002* (2013.01); *B65D 2101/0023* (2013.01)

(58) Field of Classification Search
CPC ..... B65D 41/3404; B65D 47/265; B65D 2101/0023; B65D 51/002
(Continued)

(56) References Cited

U.S. PATENT DOCUMENTS 1,189,465 A * 7/1916 Mayo ..... 215/247
2,142,278 A 1/1939 Mendelson et al.
(Continued)

FOREIGN PATENT DOCUMENTS

DE 22 00 68 9/1909
DE 220068 C1 3/1910
(Continued)

*Primary Examiner* — Andrew T Kirsch
*Assistant Examiner* — Don M Anderson
(74) *Attorney, Agent, or Firm* — Millen, White, Zelano & Branigan, PC

(57) ABSTRACT

A closure (2) for closing an opening of a container (1) for storing and removing sterile or moisture-sensitive media has a closure cap (3), which can be connected to the container in a fluid-tight manner, and a piercable, self-closing septum (20), which closes at least one removal opening (7) in the closure cap (3) in a fluid-tight manner, wherein the closure (2) has a rotatably mounted protective cap (4) with a cutout (5). The cutout (5) is arranged off-centre in the protective cap (4) and the closure cap (3) has off centre a closure region (9) which is not impinged by the at least one removal opening (7) and is larger than the cutout (5) in the protective cap (4). The closure (2) has a latching mechanism, which is suitable for arranging the protective cap (4) in relation to the closure cap (3) in such a way that the cutout (5) in the protective cap (4) is aligned either in line with the or a removal opening (7) in the closure cap (3) or at a distance from the removal opening or openings (7). The closure (2) has at least one tamper-proof means of protection.

5 Claims, 4 Drawing Sheets

Figure 1:
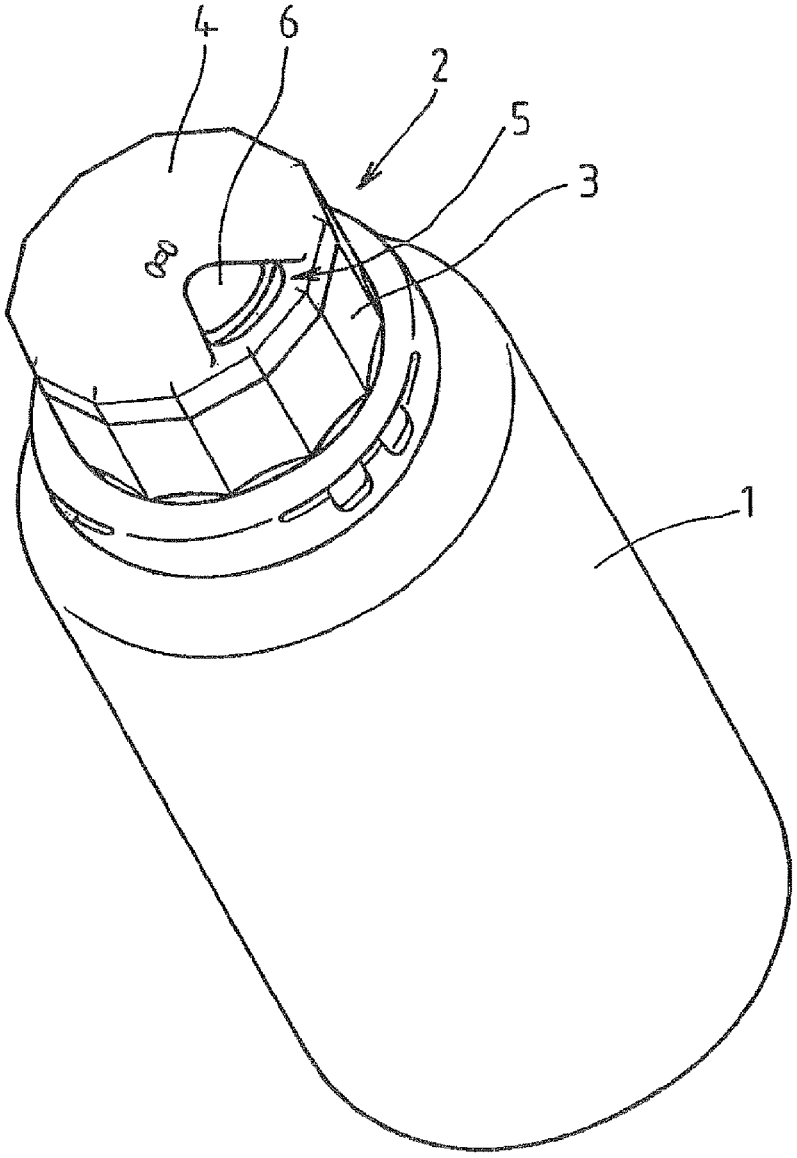

(58) Field of Classification Search
USPC ..... 215/247, 249, 254; 220/253
See application file for complete search history.

(56) References Cited

U.S. PATENT DOCUMENTS

| | | | | | |
|---|---|---|---|---|---|
| 2,183,585 | A | | 12/1939 | Peters et al. | |
| 2,459,304 | A | * | 1/1949 | Blank | 215/247 |
| 2,608,972 | A | | 9/1952 | Vilhelm et al. | |
| 2,629,379 | A | * | 2/1953 | Fields | 604/415 |
| 3,194,455 | A | * | 7/1965 | Castelli | 222/545 |
| 3,209,964 | A | * | 10/1965 | Knight | 222/545 |
| 3,260,422 | A | * | 7/1966 | Fillmore et al. | 222/485 |
| 3,260,423 | A | * | 7/1966 | Fillmore et al. | 222/485 |
| 3,260,426 | A | * | 7/1966 | Ayotte | 222/545 |
| 3,325,066 | A | * | 6/1967 | Allen | 222/545 |
| 3,424,329 | A | * | 1/1969 | Hershberg et al. | 215/247 |
| 3,855,997 | A | * | 12/1974 | Sauer | 600/573 |
| 4,076,152 | A | * | 2/1978 | Mumford | 222/545 |
| 4,254,884 | A | * | 3/1981 | Maruyama | 215/232 |
| 4,299,339 | A | * | 11/1981 | Giroux et al. | 222/153.14 |
| 4,437,593 | A | * | 3/1984 | Bullock, III | 222/153.07 |
| 4,613,063 | A | * | 9/1986 | Wright | 222/153.14 |
| 4,934,546 | A | * | 6/1990 | Markley | B65D 41/485 215/256 |
| 4,984,700 | A | * | 1/1991 | Knickerbocker | B65D 51/18 215/204 |
| 5,183,171 | A | * | 2/1993 | Pherigo | 220/258.3 |
| 5,269,432 | A | * | 12/1993 | Beckertgis | 220/253 |
| 5,388,731 | A | * | 2/1995 | Mengeu et al. | 222/545 |
| 5,680,968 | A | * | 10/1997 | Moore | 222/480 |
| 5,992,660 | A | * | 11/1999 | Miura et al. | 215/247 |
| 6,006,932 | A | | 12/1999 | Morini et al. | |
| 6,988,642 | B2 | * | 1/2006 | Gallo et al. | 222/506 |
| 7,438,204 | B2 | * | 10/2008 | Conway et al. | 222/486 |
| 7,766,197 | B2 | * | 8/2010 | Getsy | 222/480 |
| 2004/0217082 | A1 | * | 11/2004 | Claessens | 215/249 |
| 2007/0199962 | A1 | * | 8/2007 | Mengeu | 222/575 |
| 2010/0176080 | A1 | * | 7/2010 | Grunert et al. | 215/247 |

FOREIGN PATENT DOCUMENTS

| | | | |
|---|---|---|---|
| DE | 220068 | W | 3/1910 |
| EP | 1415931 | A2 | 10/2003 |
| EP | 1 415 931 | | 5/2004 |
| JP | 2004-149223 | A | 5/2004 |
| WO | PCT2008004363 | R | 6/2008 |
| WO | PCT2008004363 | W | 6/2008 |

* cited by examiner

CLOSURE WITH MEMBRANE AND ROTATABLE PROTECTIVE CAP

The invention relates to a closure for sealing an opening of a container for the storage and removal of sterile or moisture-sensitive media having a closure cap which can be connected to the container in a liquid-tight manner and having a piercable, self-sealing septum which seals at least one removal opening in the closure cap in a liquid-tight manner.

Both in research and also in connection with industrial analytical and production processes, there is often a need for sterile or moisture-sensitive media, which have to be stored over a long period and kept ready for occasional use or essentially continuous removal of small amounts of the medium. The removal of a requisite amount of the medium should be possible in a simple manner in such a way that contamination of the medium not yet needed is excluded as far as possible.

For this purpose, it is known to seal suitable containers, such as, for example, bottles made from glass or plastic, by means of a closure which has a removal opening, which is in turn sealed in a liquid-tight manner by means of a septum. Known closures of this type for such containers have for this purpose one or more removal openings, which are covered or sealed in a liquid-tight manner on their side facing the interior of the container by a septum covering the one or more removal openings.

In order to be able to remove a medium located in the container, the septum is pierced by means of a cannula, and the requisite amount of the medium is removed. The septum advantageously consists of a material which—like the container material—is inert to the medium to be stored in the container and at the same time can be pierced easily in order to re-seal automatically in a liquid-tight manner after the removal of the medium.

Irrespective of the material used in each case, each piercing of the septum leaves behind damage to the material, often visible, so that, in particular after a number of removal operations, liquid-tight or sterile sealing of the container by the repeatedly pierced septum can no longer be reliably guaranteed.

It has been found in practice that repeated piercing of the septum at the same point can result in the septum no longer completely sealing reliably in this area, meaning that sterile and dry storage of the medium located in the container is no longer guaranteed. For this reason, the aim is usually to avoid repeatedly piercing the same area of the septum and using it for removal of the medium located in the container.

In order to ensure the sterility necessary for some applications and additionally to prevent undesired ingress of moisture into the interior of the container, it is known from practice to provide closures of this type with an additional protective cap. This protective cap is usually screwed or pushed onto the closure and completely covers the one or more removal openings. Before the medium located in the container can be removed, the protective cap must be removed in order to uncover the removal opening sealed by means of the septum. Handling of closures of this type is made more difficult by the additional protective cap.

The object of the present invention is accordingly to design a closure of the generic type indicated at the outset in such a way that the medium located in the container is protected against environmental influences as reliably as possible and at the same time rapid and simple removal of the medium is facilitated.

This object is achieved in accordance with the invention in that the closure has a rotatably mounted protective cap having a cut-out. The rotatably mounted protective cap does not have to be detached from the closure or closure cap in order to uncover the removal opening arranged in the closure cap. The protective cap merely has to be rotated until the cut-out in the protective cap uncovers a removal opening in the closure cap in an area hitherto covered by the protective cap and makes it accessible for removal of the medium. However, it may be sufficient merely for the rotatably mounted protective cap to have markings which indicate a new, hitherto unused area of a removal opening and for these markings to be re-positioned relative to the removal opening and the removal openings by rotating the protective cap.

A protective cap rotatably mounted on the closure additionally has the advantage that the protective cap does not have to be detached completely from the closure, meaning that it is not necessary to handle any loose individual parts, which could make the maintenance of sterile or high-purity working conditions more difficult. The rotatably mounted protective cap can also be actuated reliably in a simple manner with one hand or with the hand gripping the container, enabling, for example, the septum to be pierced with a second hand and the medium located in the container to be removed.

According to a particularly advantageous embodiment of the inventive idea, it is provided that the at least one removal opening in the closure cap and the cut-out in the protective cap are each arranged off-centre and that the closure cap has off-centre an area which is not encompassed by the at least one removal opening and is larger than the cut-out in the protective cap. If no medium has to be removed from the container for an extended period and in particular before first use of the container, the protective cap can be rotated or positioned relative to the closure cap in such a way that the cut-out of the protective cap is located above an area of the closure cap which has no removal opening, so that the septum arranged thereunder is either completely covered by the closure cap or by the protective cap and is protected against outside ambient influences. Only when the protective cap is rotated relative to the closure cap so that the cut-out in the protective cap comes to rest at least partially over a removal opening in the closure cap is the corresponding area of the septum accessible from the outside and can be pierced for removal of the medium located in the container.

It is preferably provided that the closure cap has a plurality of removal openings arranged off-centre and that the cut-out in the protective cap is matched to the dimensions of the removal openings. The closure cap may have, for example, three, five or more removal openings, preferably circular or in the shape of an arc segment. The plurality of removal openings are each sealed by a septum. The septum here can either be designed in one piece and essentially cover the entire opening of the container and thus also all removal openings, or alternatively a plurality of septa, each covering an assigned removal opening, may be provided.

The cut-out in the protective cap is advantageously matched to the dimensions of the removal openings and corresponds in shape and dimensions to the advantageously uniform shape of the plurality of removal openings. However, it is also conceivable for the cut-out in the protective cap to be significantly smaller than the dimension of the individual removal openings, so that the cut-outs in the protective cap can be re-positioned a number of times within a removal opening in order in each case to uncover a hitherto unused area of the septum before the cut-out in the protective cap is positioned over a new removal opening.

According to an embodiment of the inventive idea, it is provided that the protective cap can be connected to the closure cap in a detachable manner in such a way that detachment of the protective cap from the closure cap for the first time is evident. For certain applications, it may be advantageous for it to be possible for the medium located in the container to be removed simultaneously from a plurality of removal openings. It is likewise conceivable for air or a suitable displacement medium to be introduced into the container through a removal opening in order to support the removal of the medium located in the container through another removal opening. In order to make a larger area of a single removal opening or alternatively a plurality of removal openings accessible at the same time, the protective cap can be detached from the closure cap. However, the closure has a tamper-proof protection means, making detachment of the protective cap from the closure cap for the first time evident and enabling it to be taken into account on later use of the container in question.

It is likewise conceivable that the protective cap can be connected to the closure cap in a detachable manner in order to facilitate simple and rapid removal of the protective cap if necessary, for example in the case of corresponding requirements during use. For this purpose, the protective cap may be rotatably mounted on the closure cap in a latched manner or with a snap closure. A suitable attachment device can in this case be arranged or designed either centrally in the region of the axis of rotation of the protective cap or along the periphery of the protective cap.

It is preferably provided that the closure cap can also be connected to the container in a detachable manner in such a way that detachment of the closure cap from the container for the first time is evident. In particular for rapid removal of large amounts of the medium located in the container, it may be advantageous for the closure cap to be detached completely from the container, so that the opening of the container is uncovered and the medium located in the container can be removed or, for example, poured out. In order, on later use of the container used temporarily without closure cap and subsequently re-sealed by means of the closure cap, also to be able to establish this at a later point in time and, where appropriate, take this into account, the closure cap has a tamper-proof protection means.

In order to simplify handling of the closure and also to facilitate one-handed actuation of the protective cap or uncovering of the septum for piercing by means of a cannula and removal of the medium located therein, it is provided that the protective cap has at least one shape projecting to the side. The protective cap may also have a polygonal, for example octagonal or dodecagonal cross-sectional area, so that, irrespective of the particular alignment of the container or protective cap during one-handed gripping of the container, the protective cap can be reliably actuated and rotated with the thumb and index finger of the hand gripping the container.

Figure 2:
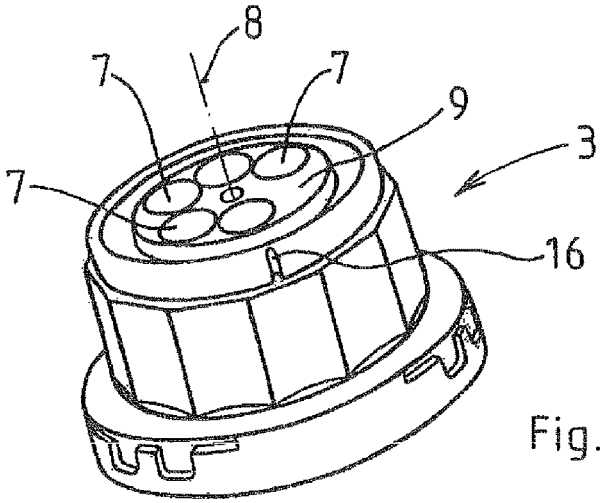
Figure 3:
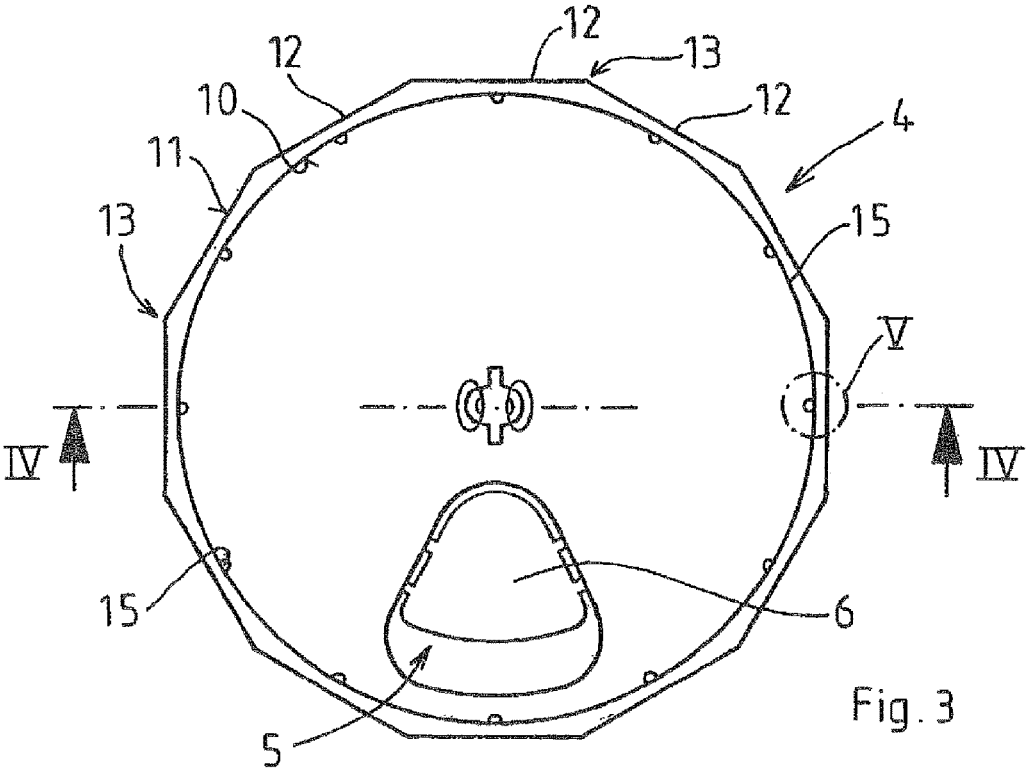
Figure 4:
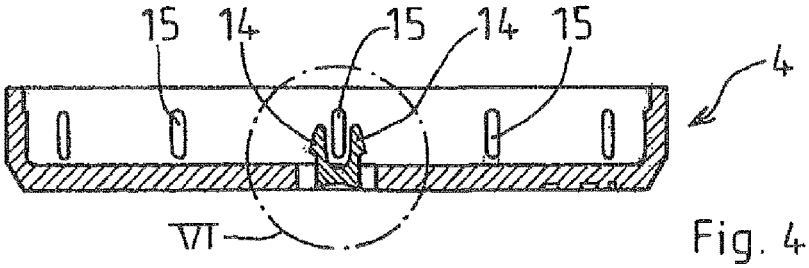
Figure 5:
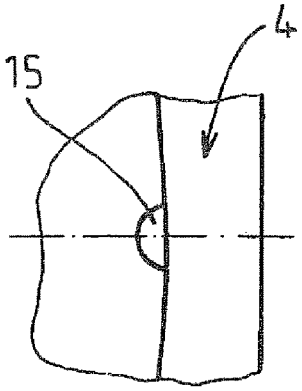
Figure 6:
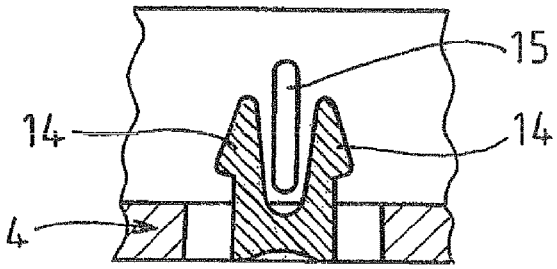
Figure 7:
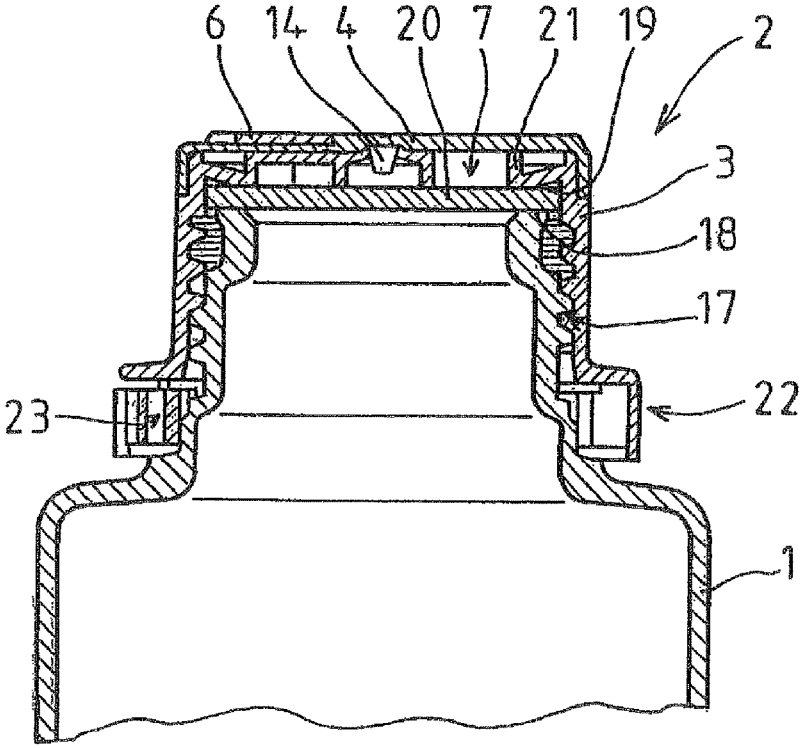
Figure 8:
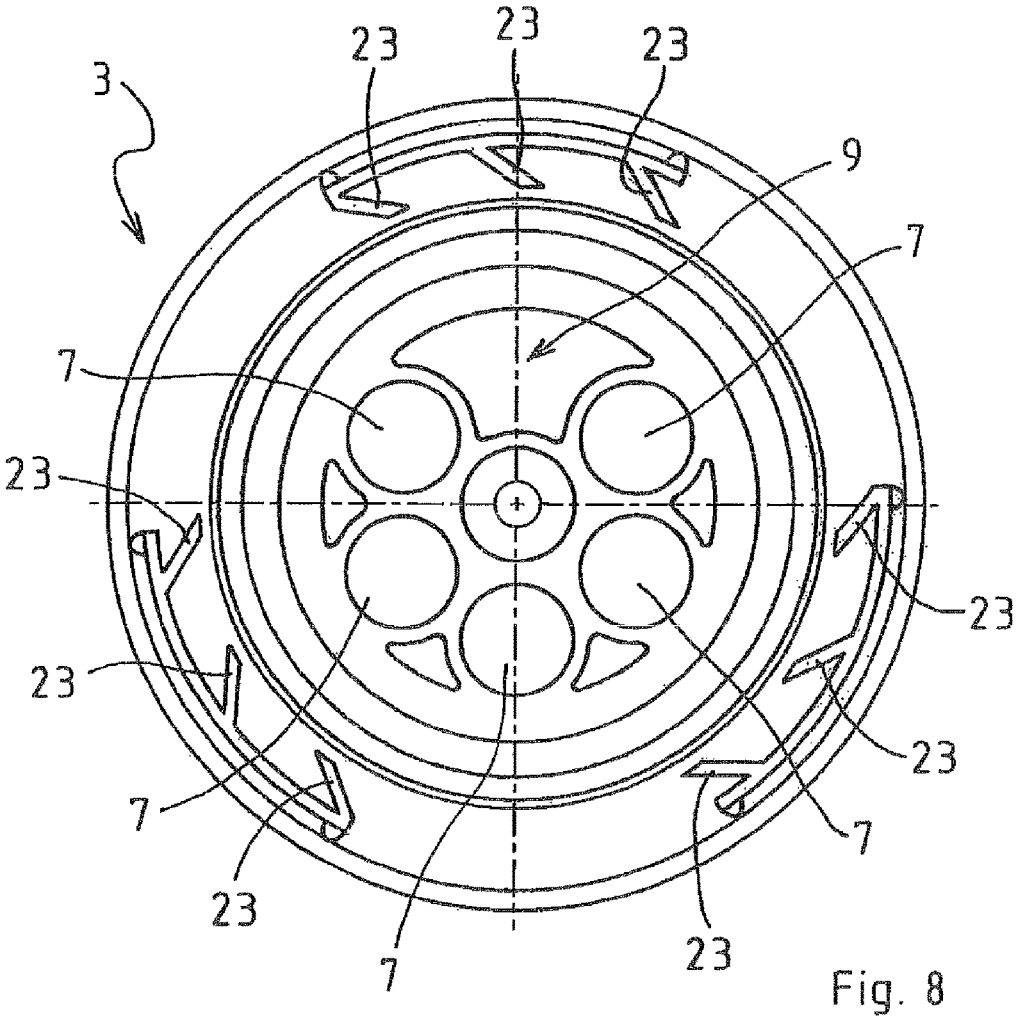

An illustrative embodiment of the inventive idea is explained in greater detail below and is depicted in the drawing, in which:

FIG. 1 shows an oblique view of a container which is sealed by means of a closure according to the invention, FIG. 2 shows an oblique view of a closure cap with a plurality of removal openings, FIG. 3 shows an enlarged plan view of a protective cap, FIG. 4 shows a sectional view along line IV-IV of the protective cap depicted in FIG. 3, FIG. 5 shows an enlarged sectional detail view V of the protective FIG. 3, FIG. 6 shows an enlarged detail view VI of the protective cap shown in FIG. 3 and FIG. 7 shows a merely partial sectional view along line VII-VII of the container depicted in FIG. 1 with the closure, FIG. 8 shows a view from below of the closure caps shown in FIG. 2.

The container 1 depicted in FIG. 1 has an opening, not visible in this view, which is sealed by a closure 2. The closure 2 has a closure cap 3 and a protective cap 4 arranged in a rotatable manner on the closure cap 3. The protective cap 4 has a cut-out 5, which, in the delivery state of the completely filled container 1, is completely covered by a safety cover 6. In order to be able to remove a sterile or moisture-sensitive medium located in the container 1 for the first time, the safety cover 6 must be detached from the protective cap 4, so that the cut-out 5 located beneath this becomes accessible from the outside and facilitates removal of the medium.

For this purpose, the closure cap 3 depicted singly in FIG. 2 has a plurality of removal openings 7. In the illustrative embodiment depicted in the figures, five circular removal openings 7 are arranged at a distance from one another and at a distance from an axis of rotation 8 of the closure cap 3. An area 9 which is not encompassed by the removal openings 7 and whose dimensions are greater than the dimensions of each removal opening 7 is arranged between two adjacent removal openings 7. In this area 9, the closure cap 3 basically covers the assigned area of the opening of the container 1, irrespective of the particular alignment of the protective cap 4.

For illustration, FIGS. 3 and 4 show an enlarged view of the protective cap 4. The cut-out 5 of the protective cap 4 is covered to a predominant proportion by the safety cover 6, which is formed in one piece on the protective cap 4 and is connected to the protective cap 4 via narrow webs. The protective cap 4 designed in this way can be produced inexpensively and in a simple manner using standard injection-moulding processes from a suitable material, such as, for example, polyethylene (PE).

The protective cap 4 has an essentially cylindrical inside surface 10 and an outside surface 11 which is divided into twelve flat surfaces 12 along a periphery of the protective cap 4. The flat surfaces 12 each have an angle of 30° to an adjacent flat surface 12. The edges 13 formed in this way enable the protective cap 4 to be gripped and rotated in a simple manner, simplifying one-handed operation.

The protective cap 4 has in its centre two latch elements 14, which can be introduced into an assigned opening in the closure cap 3 and permanently connect the protective cap 4 to the closure cap 3. If the protective cap 4 should be detached from the closure cap 3, at least one of the two latch elements 14 would have to be bent or broken off for this purpose, meaning that complete detachment of the protective cap 4 from the closure cap 3 for the first time is evident at any time. This likewise represents a tamper-proof protection means. One possible design of the latch elements 14, which is realised in the illustrative embodiment, is shown further enlarged in FIG. 6.

In order to simplify or specify the alignment of the protective cap 4 relative to the closure cap 3, the protective cap 4 has on the inside surface 10 a plurality of, in the illustrative embodiment shown twelve, inwardly projecting, bead-like latch elements 15. The latch elements 15 can each be assigned to a flat surface 12. The closure cap 3 has a groove 16 matched to the shape of the latch elements 15 and aligned perpendicular to the peripheral direction, into which a latch element 15 can engage in each case. The groove 16 is depicted, for example, in FIG. 2.

The shape of the latch elements 15 is such that, on the one hand, rotation of the protective cap 4 is not excessively prevented, while, on the other hand, positioning of the protective cap 4 with a latch element 15 engaging into the groove 16 of the closure cap 3 is preferred. A user can accordingly, on rotation of the protective cap 4, perceive or feel the positions of the protective cap 4 specified by the latch elements 15 and thus of the cut-out 5 relative to the closure cap 3.

A possible design of the latch elements 15 is illustrated in the enlarged detail view in FIG. 5.

FIG. 7 shows a sectional view of the container 1, which, in its delivery state, is sealed by means of the closure 2.

The closure cap 3 of the closure 2 is screwed to the container 1 by means of a screw thread 17. A septum 20 is arranged between an upper edge 18 of the container and an inside 19 of the closure cap 3. The septum 20 preferably consists of silicone which is coated, on a surface facing the interior of the container 1, with an inert material, such as, for example, PTFE.

The closure cap 3 has, on the inside 19 facing the septum 20, shapes 21 arranged at a distance from an outer edge and projecting in the direction of the interior of the container. When the closure cap 3 is firmly screwed to the container 1, the inwardly projecting shapes 21 press onto the septum 20 inside the upper edge 18 of the container 1 and generate a slight deformation of the septum 20, so that the material of the septum 20 is under tension and the self-sealing properties of the material are augmented.

The screw closure of the closure cap 3 to the container 1 is also provided with a tamper-proof protection means. For this purpose, a plurality of lamellar shapes 23, which are not aligned radially inwards, but instead each have an angle of about 50° thereto, are formed on an end region 22 of the closure cap 3 facing the container 1. The container 1 has a matched shape projecting at an angle, which is designed in such a way that the shapes 23 slide virtually unhindered over the shape of the container 1 when the closure cap 3 is screwed onto the container 1, whereas the shapes 23 engage with the associated shape of the container 1 when the closure cap 3 is unscrewed and have to be bent with increased application of force in order to release the closure cap 3. In this way, the closure 2 can be removed completely from the container 1 in order to uncover the container opening completely if necessary or desired in an individual case. However, opening of the container 1 in this way causes a permanent deformation of the lamellar shapes 23, which is evident at any later time, likewise providing tamper-proof protection.

The closure 2 can be produced using any injection-mouldable polymer which, however, is preferably inert to aggressive solvents, but also to leaching.

It is also conceivable for one direction of rotation of the protective cap 4 relative to the closure cap 3 to be prespecified. For this purpose, comparable lamellar shapes 23 may, for example, be provided on the protective cap 4 or closure cap 3 which allow only one direction of rotation of the protective cap 4 and block the opposite direction of rotation. In this way, it is possible to prevent the protective cap 4 from being rotated a number of times in different directions and the cut-out 5 from being positioned repeatedly over a removal opening 7 which has already been used for removal of the medium. By means of a measure of this type, the sterility of the medium located in the container 1 can also be substantially guaranteed over a number of removal operations.

The illustrative embodiment depicted in the drawing is merely intended for illustration and allows various variants within the scope of the knowledge available to the person skilled in the art. Owing to the general validity of the inventive principle described, however, the illustrative embodiment presented as an example is not suitable for reducing the scope of protection of the present application only to this embodiment.

Unless expressly indicated as a feature which is essential to the invention, it goes without saying to the person skilled in the art that the dimensions or relative size ratios shown or depicted in the drawing are merely intended to illustrate possible embodiments of the inventive principle in each case, without thus being tied to a restriction to these dimensions or size ratios.

The invention claimed is:

1. A closure (2) for sealing an opening of a container (1) for the storage and removal of sterile or moisture-sensitive media having a closure cap (3) which can be connected to the container (1) in a liquid-tight manner and having a piercable, self-sealing septum (20) which seals an off-center removal opening (7) in the closure cap (3) in a liquid-tight manner, wherein the closure (2) has a rotatable mounted protective cap (4) having only one cut-out (5) for uncovering the removal opening (7), and wherein the cut-out (5) in the protective cap (4) is matched to the dimension of the removal opening (7), and wherein closure cap (3) has a plurality of off-center removal openings (7) each of which is sealed by the septum (20) and wherein the rotation of the protective cap (4) positions the cut-out (5) to match the dimensions of each of the removal openings (7) in order to uncover it, and wherein closure cap (3) additionally comprises only one area (9) which is not encompassed by the removal openings (7) and arranged between two adjacent removal openings (7), wherein the dimensions of the area (9) are sufficient to cover an assigned area of the cut-out (5), and wherein the closure cap (3) is connected to the container (1) in a detachable manner.

2. The closure of claim 1, wherein the closure (2) has a latch mechanism, which is suitable for arranging the protective cap (4) relative to the closure cap (3) so that the cut-out (5) in the protective cap (4) is aligned either flush with the removal opening (7) in the closure cap (3) or alternatively at a distance from the removal openings (7).

3. The closure of claim 1, wherein the closure (2) has a locking mechanism which prevents the protective cap (4) from being rotated against a pre-specified direction of rotation.

4. The closure of claim 1, wherein the protective cap (4) has at least one shape projecting to a side.

5. The closure of claim 1, wherein the protective cap (4) has a plurality of latch elements (14) which connect the protective cap (4) to closure cap (3).

* * * * *